US005195510A

United States Patent [19]

Svacina

[11] Patent Number: 5,195,510

[45] Date of Patent: Mar. 23, 1993

[54] DEEP PRESSURE MASSAGE DEVICE

[76] Inventor: Lawrence M. Svacina, 2822 Tennyson St., Denver, Colo. 80212

[21] Appl. No.: 703,417

[22] Filed: May 21, 1991

Related U.S. Application Data

[63] Continuation of Ser. No. 559,822, Jul. 30, 1990, abandoned.

[51] Int. Cl.[5] ..... A61H 7/00

[52] U.S. Cl. ..... 128/61; 128/60; 128/26 128/26; 446/85; 272/68

[58] Field of Search ..... 446/111, 122, 126, 128, 446/85; 128/59-62 R, 57; 273/84 R; 272/68

[56] References Cited

U.S. PATENT DOCUMENTS

| | | | |
|---|---|---|---|
| 1,886,544 | 11/1930 | Hemp | 128/59 |
| 2,633,844 | 4/1953 | Herndon | 128/60 |
| 4,577,858 | 3/1986 | Higami | 128/26 |
| 4,621,622 | 11/1986 | Beck | 128/57 |

FOREIGN PATENT DOCUMENTS

| | | | |
|---|---|---|---|
| 1332044 | 6/1963 | France | 446/126 |
| 1431757 | of 1989 | U.S.S.R. | 128/57 |
| 16783 | of 1899 | United Kingdom | 128/57 |

*Primary Examiner*—Robert A. Hafer
*Assistant Examiner*—David J. Kenealy
*Attorney, Agent, or Firm*—Fields, Lewis, Pittenger & Rost

[57] ABSTRACT

A massage device disclosed has a frame portion with a window into which at least the middle and ring fingers will insert for the full extent of the fingers for hand-held movement. At least a pair of laterally spaced outwardly projecting massage portions are rigidly affixed to and project beyond the frame portion so that as the hand is moved over and against the outer surface of a living body the massage portions penetrate the body tissue and perform an effective and efficient deep pressure massage action.

6 Claims, 1 Drawing Sheet

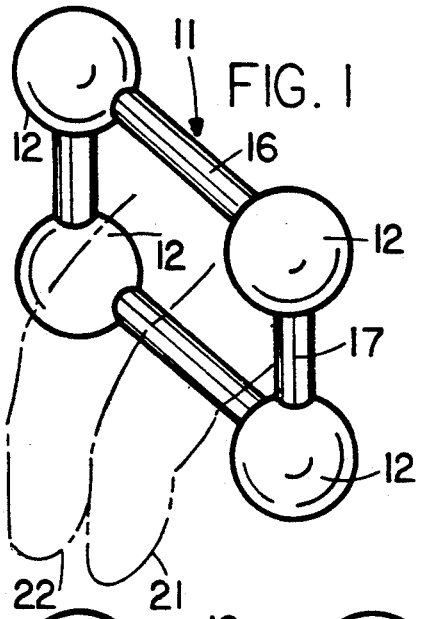
FIG. 1
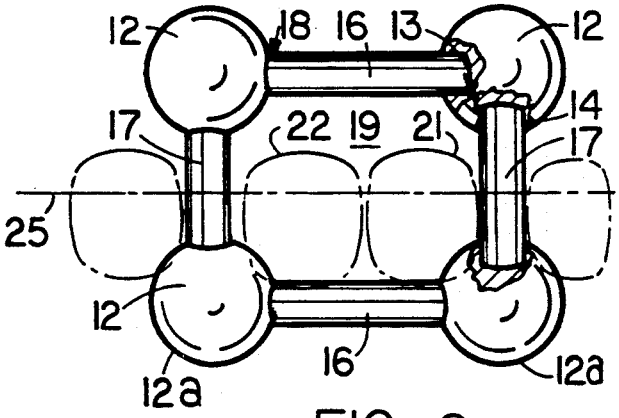
FIG. 2
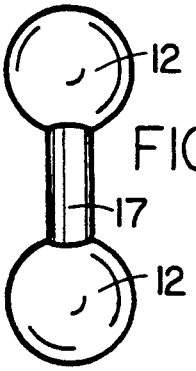
FIG. 3
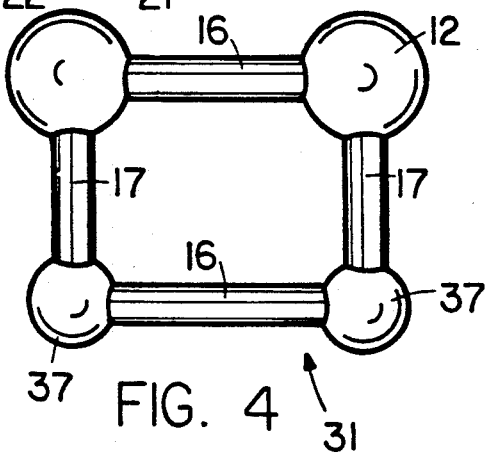
FIG. 4
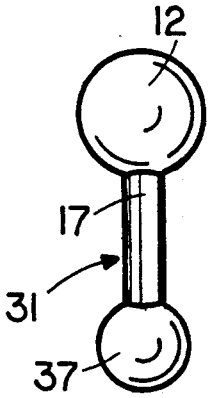
FIG. 5
FIG. 6
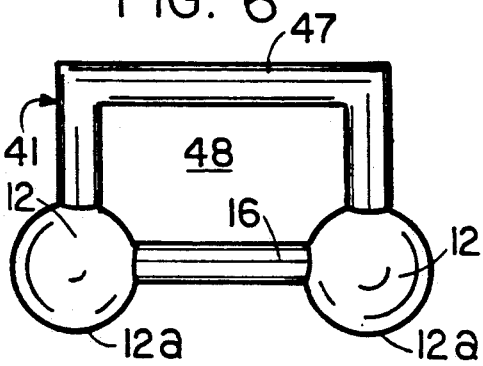
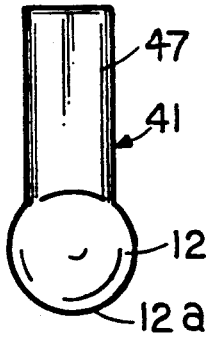
FIG. 7

DEEP PRESSURE MASSAGE DEVICE

This application is a continuation of U.S. patent application Ser. No. 559,822, filed Jul. 30, 1990, abandoned.

TECHNICAL FIELD

This invention relates to body massage devices and more particularly to a novel and improved deep pressure massage device for living bodies.

BACKGROUND ART

A variety of massage devices intended to be hand manipulated over portions of a living body have heretofore been provided for body massaging purposes.

Herndon No. 2,633,844 discloses a massage device including four generally spherical massage elements arranged as two pairs for free rotation of the massaging elements together with a gripping handle for the user.

Nakayama Nos. 2,836,175 and 3,645,257 and Sekiguchi No. 3,625,204 disclose a massage device with a plurality of spaced, rotatable, massaging elements mounted on a hand-held board.

Lancellotti No. 3,831,592 discloses a trigger point instrument having a pair of spaced massaging elements mounted on upstanding legs.

DISCLOSURE OF INVENTION

A massage device for living bodies disclosed includes a frame portion with a window into which preferably the middle finger and ring finger will slidably insert past the larger knuckles for hand-held movement by the hand of the user and at least one pair of laterally spaced, bulbous massage portions that are affixed to and project outwardly from the frame portion. The device is moved by hand motion with the massage portions contacting and penetrating the muscles of a living body to perform deep pressure massaging.

One embodiment has generally four spherical bodies of a corresponding size connected in a rectangular configuration by rods. Another embodiment has two sets of generally spherical bodies of different sizes and a third embodiment has only two laterally spaced, bulbous massage portions with spherical contact surfaces.

BRIEF DESCRIPTION OF THE DRAWINGS

Details of this invention are described in connection with the accompanying drawings which like parts bear similar reference numerals in which:

FIG. 1 is a perspective view of a massage device embodying features of the present invention with the middle finger and ring finger of the hand of a user shown in dashed lines.

FIG. 2 is a front elevational view of the device of FIG. 1.

FIG. 3 is an end elevational view of the device of FIG. 1.

FIG. 4 is a front elevational view of another embodiment of the present invention having generally spherical bodies of two different sizes.

FIG. 5 is an end elevational view of the device of FIG. 4.

FIG. 6 is a front elevational view of another embodiment of the present invention.

FIG. 7 is an end elevational view of FIG. 6.

DETAILED DESCRIPTION

The massage device 11 shown in FIGS. 1–3 includes four rigid, generally spherical bodies 12 of a corresponding size and shape and each with two radial bore holes 13 and 14 arranged at right angles to one another. A first longer horizontal rigid dowel or dowel-type rod 16 extends between and connects a laterally spaced first set or pair of bodies 12. A similar second longer horizontal rigid dowel rod 16 extends between and connects a second laterally spaced set or pair of bodies 12. A first shorter rigid dowel rod 17 extends between and connects each of said first set to each of said second set of spherical bodies. End portions of each rod slidably insert into associated of the bore holes 13 and 14 so as to interconnect the bodies to form a rigid assembly of a rectangular configuration defining a rigid frame portion 18 having a central opening or window 19. The spherical bodies 12 are symmetrical with respect to a horizontal center line 25 of the assembly so the assembly is also operable in the same manner when inverted.

In use, the user will typically insert the middle finger 21 and the ring finger 22 into the window 19 past the larger finger joints as shown. The spherical bodies form massage portions **12*a* which are spherical segments extending beyond rod 16** which massage portions contact and penetrate the muscles of the living body to massage the body muscles to perform an effective and efficient deep pressure massaging action.

A satisfactory massage device made according to the present invention had spherical bodies or balls 12 of wood of a diameter of 1 inch (26 mm) and four 5/16 inch diameter dowel rods of wood. The bore holes 13 and 14 were of a depth of approximately 7 mm. The shorter dowel rods 17 were 21 mm in length and the longer dowel rods were 42 mm in length. The end portions of the dowel rods were inserted into the bore holes and secured by an adhesive or glue to make a rigid, generally rectangular assembly.

Referring now to FIGS. 4 and 5 another embodiment of a massage device 31 shown is similar in construction to that above described but has a pair of laterally spaced spherical bodies 37 which are smaller than the first pair 12 of FIGS. 1–3 to provide the option of having less penetration into the body tissue or muscle during massaging.

Referring now to FIGS. 6 and 7 there is shown a third embodiment of a massage device having but a single pair of laterally spaced spherical bodies 12 connected by a rod 16 providing outwardly protruding bulbous massage portions **12*a*. The frame portion 47 is an inverted U-shaped body having end portions that insert into suitable bore holes in the spherical bodies to form a window 48 for receiving the fingers of the user. The operation of device of FIGS. 4–7 is the same as that of the device of FIGS. 1–3**.

Although the present invention has been described with a certain degree of particularity, it is understood that the present disclosure has been made by way of example and that changes in details of structure may be made without departing from the spirit thereof.

What is claimed is:

1. A hand-held living body massage device operable by hand motion over said body comprising:

four, generally spherical bodies with each of said bodies having first and second radial bore holes disposed at right angles to one another, a first longer dowel-type rod extending between and connecting by means of the first of said bore holes a first pair of laterally spaced spherical bodies and a second longer dowel-type rod extending between and connecting by means of the first of said bore holes a second pair of laterally spaced bodies, and a first shorter, dowel-type rod extending between and connecting by means of the second of said bore holes one of said spherical bodies of said first pair of spaced bodies and one of said spherical bodies of said second pair of spaced bodies and a second shorter dowel-type rod extending between and connecting by means of the second of said bore holes the other of said spherical bodies of said first pair of spaced bodies and the other of said spherical bodies of said second pair of spaced bodies to form a rigid assembly arranged in a rectangular configuration defining a rigid frame portion with a window sized for receiving at least the middle finger and ring finger of the hand of a user in a relatively close fitting relation with said frame portion when the ring finger and middle finger are inserted past the larger finger joints, whereby an outer spherical surface area of one of said pairs of laterally spaced bodies provides massage portions for contacting and penetrating a living body as said massage portions are moved against said living body by moving the hand of a user to perform an effective and efficient deep pressure massaging action on the muscles and tissue of said living body.

2. A massage device as set forth in claim 1 wherein said bodies and rods are made of wood.

3. A massage device as set forth in claim 1 wherein said spherical bodies have a diameter of one inch and said dowel rods have a diameter of 5/16 inch.

4. A massage device as set forth in claim 1 wherein said spherical bodies are symmetrical with respect to a longitudinal center line of said assembly midway between a pair of opposed extremities of said assembly on opposite sides of said line so the device is also operable in the same manner when inverted about said horizontal center line.

5. A massage device as set forth in claim 1 wherein two of said spherical bodies on one side of said center line are of a different size than the other opposite two of said spherical bodies for different depth of penetration during said massage action.

6. A hand-held living body massage device operable by hand motion over said body comprising:

a single pair of laterally spaced, generally spherical bodies with each of said bodies having first and second radial bore holes disposed at right angles to one another, a first longer dowel-type rod extending between and connecting by means of the first of said bore holes a first pair of laterally spaced spherical bodies, an inverted U-shaped rigid frame portion extending between and connecting by means of the second of said bore holes of said spherical bodies to form a rectangular configuration defining a window sized for receiving at least the middle finger and ring finger of the hand of a user in a relatively close fitting relation with said frame portion when the ring finger and middle finger are inserted past the larger finger joints, said frame portion including second shorter dowel-type rod portions having end portions that insert into said second bore holes, whereby an outer spherical surface area of one of said pairs of laterally spaced bodies provides massage portions for contacting and penetrating a living body as said massage portions are moved against said living body by moving the hand of a user to perform an effective and efficient deep pressure massaging action on the muscle and tissue of said living body.

* * * * *